US010286277B1

(12) United States Patent
Zierke

(10) Patent No.: US 10,286,277 B1
(45) Date of Patent: May 14, 2019

(54) BASEBALL TRAINING DEVICE

(71) Applicant: Kaylyn B. Zierke, Addison, IL (US)

(72) Inventor: Kaylyn B. Zierke, Addison, IL (US)

( * ) Notice: Subject to any disclaimer, the term of this patent is extended or adjusted under 35 U.S.C. 154(b) by 0 days.

(21) Appl. No.: 16/006,998

(22) Filed: Jun. 13, 2018

(51) Int. Cl.

| | |
|---|---|
| ***A63B 69/00*** | (2006.01) |
| ***A47C 9/10*** | (2006.01) |
| ***A47C 3/00*** | (2006.01) |
| *A63B 102/20* | (2015.01) |
| *A63B 102/18* | (2015.01) |

(52) U.S. Cl.
CPC ..... *A63B 69/0002* (2013.01); *A47C 3/00* (2013.01); *A47C 9/10* (2013.01); *A63B 2069/0006* (2013.01); *A63B 2069/0011* (2013.01); *A63B 2102/18* (2015.10); *A63B 2102/182* (2015.10); *A63B 2102/20* (2015.10)

(58) Field of Classification Search
CPC ..... A63B 69/0002; A63B 2102/18; A63B 2102/182; A63B 2102/20; A63B 2069/0006; A63B 2069/0011; A47C 3/00; A47C 9/10
USPC ..... 473/417, 422, 439, 445, 446
See application file for complete search history.

(56) References Cited

U.S. PATENT DOCUMENTS

| | | | | |
|---|---|---|---|---|
| 2,586,958 | A * | 2/1952 | Keller | F41J 3/0004 273/406 |
| 3,231,280 | A * | 1/1966 | Coliins | A63B 63/06 473/194 |
| 3,391,936 | A * | 7/1968 | Grimes | A63B 63/06 473/439 |
| 3,573,867 | A * | 4/1971 | Mehrens | A63B 63/06 473/439 |
| 5,688,196 | A * | 11/1997 | O'Neil | A63B 63/06 473/439 |
| D509,551 | S * | 9/2005 | Reynolds | D21/715 |
| 7,226,372 | B2 * | 6/2007 | Flanigan | A63B 47/007 473/417 |
| 7,255,658 | B1 * | 8/2007 | VanKuiken | A63B 69/0002 473/454 |
| 7,435,194 | B1 * | 10/2008 | Lewis | A63B 69/0002 273/317.6 |
| 7,736,246 | B2 * | 6/2010 | Lortscher | A63B 69/0002 473/417 |
| 7,984,910 | B1 * | 7/2011 | Nielsen | A63B 63/00 273/359 |
| 2008/0248901 | A1 * | 10/2008 | Mosier | A63B 24/0021 473/454 |

* cited by examiner

*Primary Examiner* — Mitra Aryanpour
(74) *Attorney, Agent, or Firm* — McCracken & Gillen LLC

(57) ABSTRACT

A baseball training device for allows a catcher to easily slide back and forth behind home plate so as to give the pitcher a better target and thus improve his or her technique and accuracy when it comes to the game. The baseball training device is used with a bucket having a bottom surface and an open top, the top having a circumference of a given diameter, the device having a frame with two parallel rails spaced a predetermined distance apart along their length; and a platform attached to said parallel rails, the platform having a top surface and a width that spans said predetermined distance between said parallel rails, so that the platform is movable along said length of said rails, the platform having a groove with a circumference approximately the same as the circumference of the top of the bucket for receiving the top of the bucket.

10 Claims, 6 Drawing Sheets

BASEBALL TRAINING DEVICE

TECHNICAL FIELD

Various example embodiments relate generally to sports training apparatus and more particularly to a baseball training device for use by a catcher.

BACKGROUND

Bat-and-ball games such as baseball, softball and cricket involve a pitcher throwing a ball to a batter who attempts to hit the ball. A catcher is positioned behind the batter to catch the ball when the batter misses. The pitcher and catcher cooperate to prevent the batter from hitting the ball while providing valid pitches, i.e. pitches within the strike zone of the batter as determined by an umpire standing behind the catcher.

To assist the pitcher, the catcher generally holds the glove within the strike zone of the batter, which requires the catcher to squat, placing a considerable strain on the catchers legs, knees and feet. While this stance is required during a game, it can become burdensome during practice and training sessions, particularly if the training is focusing on the efforts of another player, such as the pitcher or batter. For this reason, it is helpful to provide a seat for the catcher to use in these situations.

SUMMARY

Example embodiments encompass a baseball training device for use by a catcher when receiving balls thrown by a pitcher. The device allows the catcher to easily slide back and forth behind home plate so as to give the pitcher a better target and thus improve his or her technique and accuracy when it comes to the game.

In an embodiment, a baseball training device is used with a bucket having a bottom surface and an open top, said top having a circumference of a given diameter, the device having a frame with two parallel rails spaced a predetermined distance apart along their length; and a platform attached to said parallel rails, said platform having a top surface and a width that spans said predetermined distance between said parallel rails, wherein said platform is movable along said length of said rails, said platform also having a groove with a circumference approximately the same as the circumference of the top of the bucket for receiving the top of the bucket.

In a further embodiment, the platform further includes a plurality of mounts attached to said platform on a bottom surface opposite the top surface, each mount slideably engaging with one of the two parallel rails. In another embodiment, each mount further comprises a plurality of ball bearings retained within a race.

In another embodiment, the platform is a square of approximately 1 foot on each side. Further, the platform includes a plurality of clamps or straps for retaining the bucket in the groove.

In yet another embodiment, the circumference of the groove is approximately the same as the circumference of the top of the bucket so that the bucket is retained in the groove by a friction fit.

In a further embodiment, the frame is approximately 30 to 36 inches long and includes two support members each attached to one of the parallel rails; and a plurality of braces attached between the support members to maintain the rails in a parallel orientation along their length.

In another embodiment, stoppers are attached at both ends of each rail to retain the platform on the rails

DESCRIPTION OF THE DRAWINGS

Some example embodiments will now be described with reference to the accompanying drawings in which.

DETAILED DESCRIPTION

Reference will now be made in detail to one or more embodiments, however, it should be understood that the invention is not limited to any particular embodiment. On the contrary, the invention includes alternatives, modifications, and equivalents as may come within the spirit and scope of the appended claims. Embodiments below are described using the general term baseball. It should be understood that the invention may be used in connection with any bat-and-ball game that involves one player, a pitcher, throwing a ball to another player, a catcher. Bat-and-ball games include baseball, softball and cricket, for example.

Figure 1:
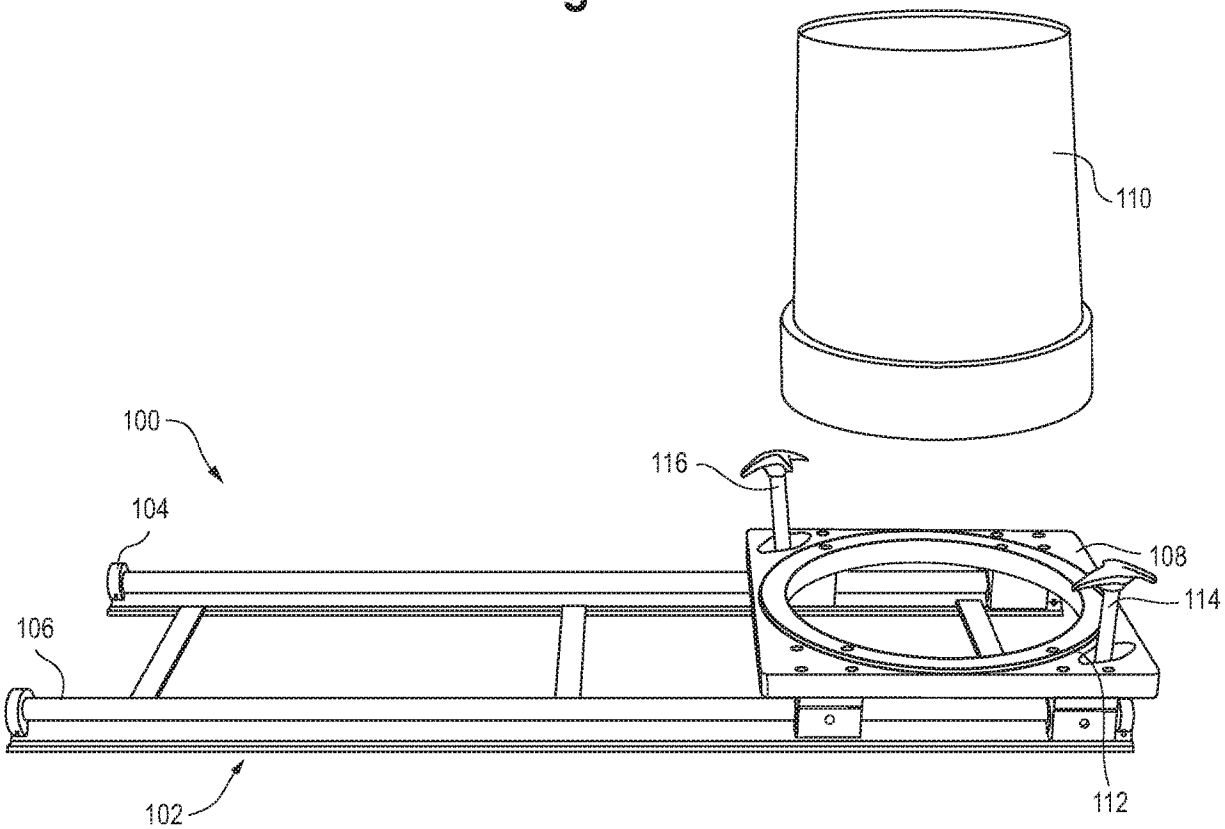
FIG. 1 depicts a side view of a baseball training device.

An embodiment of a baseball training device 100 is shown in FIG. 1. A frame 102 includes two rails, 104 and 106. Platform 108 is mounted to frame 102 such that it freely slides back and forth on rails 104 and 106.

Baseball training device 100 is used with a seating device, for example, bucket 110. To prepare baseball training device 100 for use, bucket 110 is inserted into groove 112 in platform 108. The circumference of groove 112 is sized to provide a tight fit for bucket 110 so as to help retain bucket 110 in groove 112 during use. In addition, optional clamps 114 and 116 are provided to engage with a ridge on bucket 110 to more securely attach bucket 110. Although embodiments below are shown and discussed with a representative five gallon bucket because this type of bucket is widely available, any type of bucket or raised platform may be used with baseball training device 100 as long as it provides a seat at a height of approximately 17 inches from the ground when attached to platform 108.

Baseball training device 100 is used by a catcher when receiving balls thrown by a pitcher. Different types of pitches require different target locations relative to the batter and home plate. During a game, a catcher gives the pitcher a target by moving his or her body behind the ball. During a practice session or when a pitcher is warming up in the bullpen, the catcher has much less mobility and generally puts his or her glove there as a target and fully relies on the glove. Baseball training device 100 allows the catcher to get behind the glove to give the pitcher a better target and thus improve his or her technique and accuracy when it comes to the game. Thus, while device 100 helps reduce stress on the catcher's knees and provides additional mobility, it is also beneficial for pitchers.

Frame 102 is approximately 34 inches long. This dimension is based on the distance to move to one side of home plate to the other side of home plate although any dimension between approximately 30 to 36 inches may be used.

Figure 2:
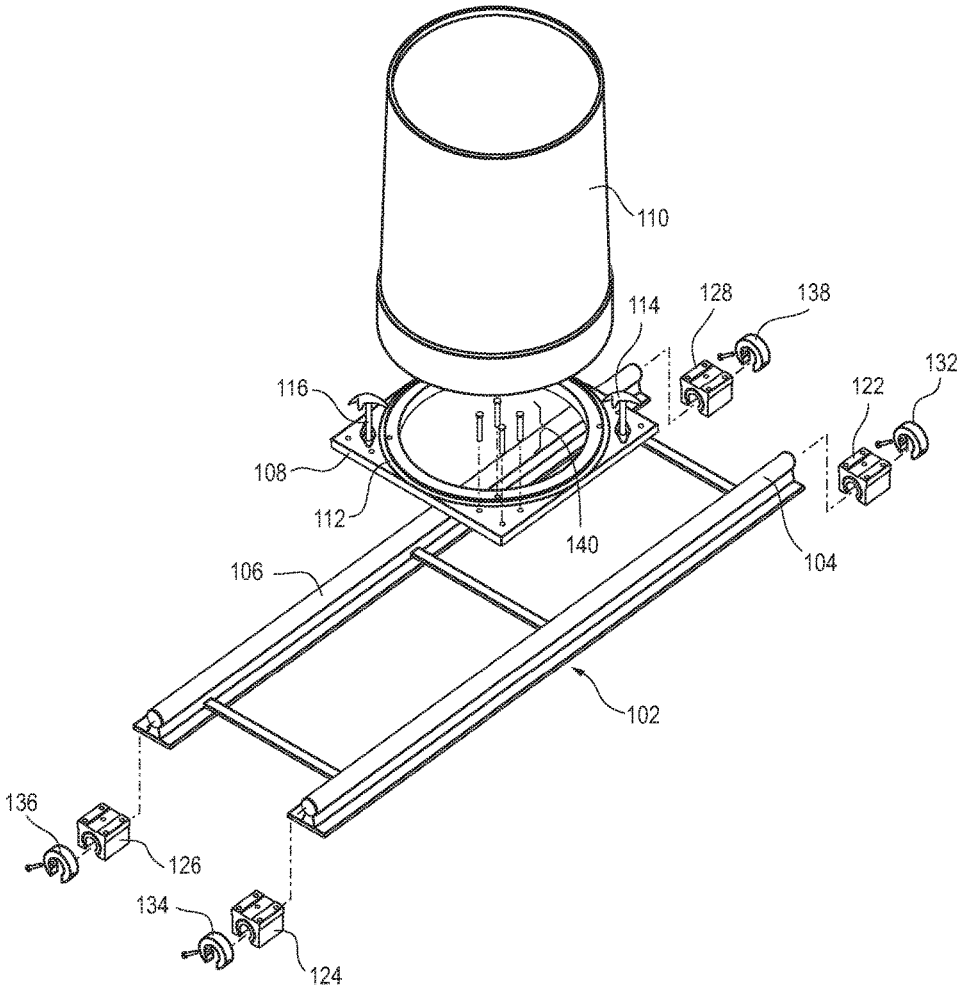
FIG. 2 depicts an exploded view of the baseball training device of FIG. 1.

An exploded view of baseball training device is shown in FIG. 2. Like reference numerals designate like parts in all figures. In addition to frame 102, rails 104, 106, platform 108, groove 112 and clamps 114, 116, FIG. 2 also depicts mounts 122, 124, 126 and 128 which are attached to the underside of platform 108 by screws 140. Although each mount is shown as attached with four screws, any number of screws could be used. Mounts 122, 124, 126 and 128 are slideably attached to rails 104 and 106 as will be discussed in more detail below. Clamps 114 and 116 are attached to platform 108 as will be discussed in more detail below. Stoppers 132 and 134 are attached to the ends of rail 104 while stoppers 136 and 138 are attached to the ends of rail 106 to prevent platform 108 from sliding all the way off rails 104 and 106.

Figure 3:
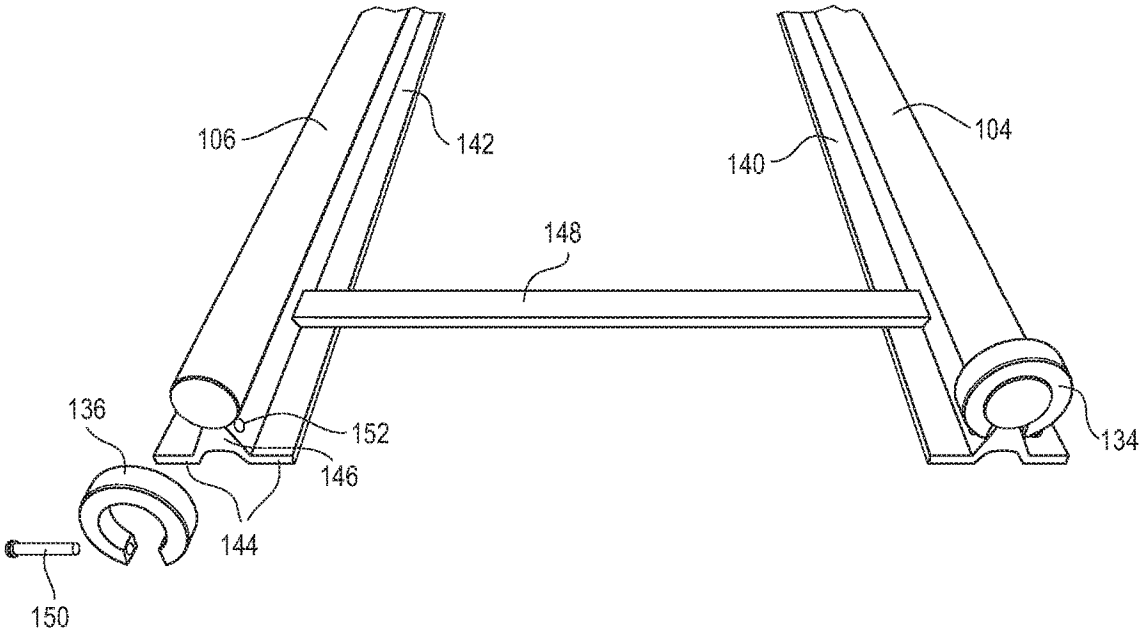
FIG. 3 depicts a close-up view of a frame of the device of FIGS. 1 and 2.

A close-up view of one end of frame 102 is shown in FIG. 3. Rails 104 and 106 are attached to support members 140 and 142 respectively. Support member 140 and 142 have a cross-section which is discussed with respect to support member 142. A stable platform area 144 is provided to rest on the ground while a raised ridge 146 supports rail 106. Rail 106 is attached to raised ridge 146 by a bolt from the underside of support member 142 (not shown). In an alternative, rail 106 may be attached to raised ridge 146 by screws, rivets or welding, for example. As shown, support member 140 has the same profile as support member 142. The exact cross-section of supports 140 and 142 may be varied while still providing the functionality described above.

A series of braces 148 are attached between support members 140 and 142. Although only one brace 148 is shown in FIG. 3, several braces may be provided, as shown in FIGS. 1 and 2. Although three braces are shown, any number of braces may be used to provide additional support. The braces may be attached to support members 140 and 142 by welding or with screws, for example. Stopper 136 is attached to rail 106 by means of screw 150, which is inserted through hole 152 in ridge 146 of support member 142. Stopper 134 is shown installed on rail 104. Although a single hole 152 is shown in ridge 146, additional holes may be provided so that stopper 136 may be installed at other locations along rail 106. Stoppers 134 and 138 (FIG. 2) on the opposite ends of rails 104 and 106 are installed similarly.

Figure 4:
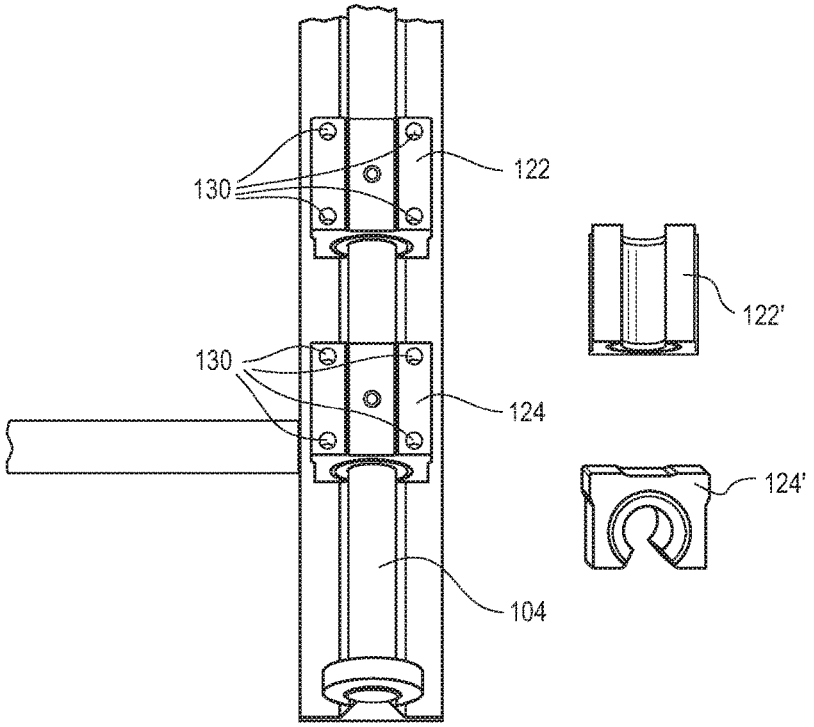
FIG. 4 depicts a close-up view of mounts of FIG. 2.

FIG. 4 depicts a close-up view of mounts 122 and 124 of FIG. 2 installed on rail 104. A bottom view of mount 122 is shown at 122' while a side view of mount 124 is shown at 124'. In an embodiment, mounts 122 and 124 are the same, as are mounts 126 and 128 (FIG. 2). In an alternative, the mounts may not be identical to each other provided they support platform 108 at an even height. Each of mounts 122 and 124 are a linear ball bearing slide having a plurality of ball bearings housed in a carriage. Each carriage includes a plurality of threaded holes 130 for attaching platform 108 as discussed with reference to FIG. 5. Each individual mount may take weight up to 250 pounds. With four of them in place, baseball training device 100 may support approximately 1,000 pounds. In an embodiment, mounts 122, 124, 126 and 128 may be chosen to collectively support any amount of weight of at least 50 lbs. As shown at 122', several ball races inside of each mount allow the mount to slide back and forth on the rail.

The ball bearing inside each mount may be sealed in several different ways. For example, two sealers are on each side of the bearing. On FIG. 4 with the close up on 124', the inner part of the bearing on either side of the rollers. That is the wiper. It is placed on both sides of the bearings. A third sealer is the bottom part of the 124' bearing. All three of these seals help maintain the function and smooth rolling capability of the mounts.

Figure 5:
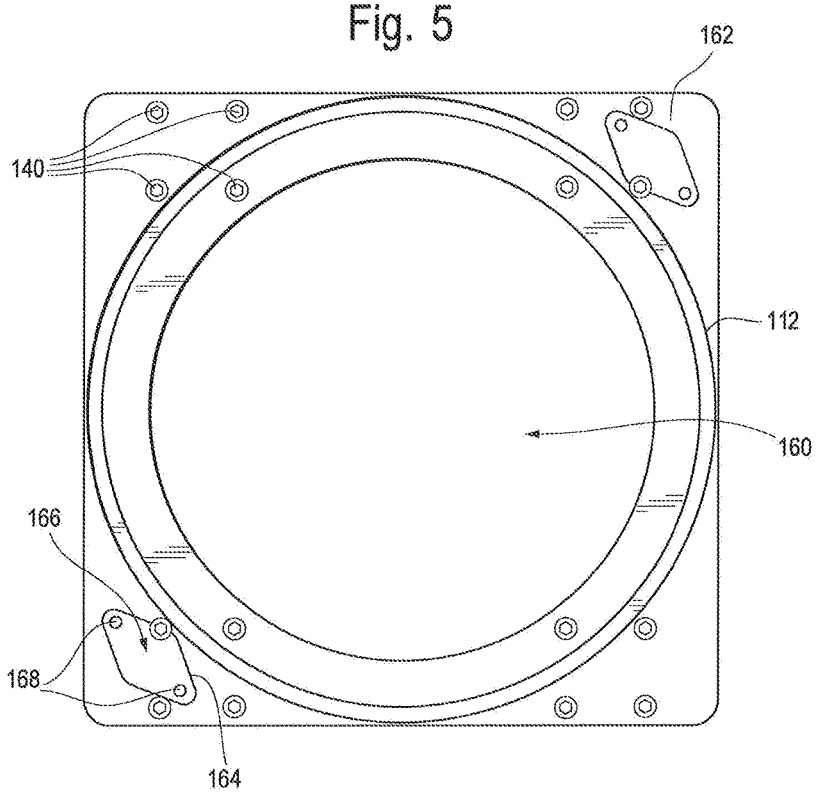
FIG. 5 depicts a top view of the platform of FIGS. 1 and 2.

FIG. 5 depicts a top view of platform 108 of FIGS. 1 and 2. As described above, groove 112 is provided to retain a bucket or other platform of a height sufficient to provide a seat for a catcher. As shown, an opening 160 is provided in the center of platform 108 to reduce the overall weight of platform 108. In an alternative, platform 108 may be a solid piece of material or different shaped openings may be provided, such as one or more squares or rectangles. Screws, represented at 140, are used to attach mounts as explained above. Screws 140 are inserted through holes in platform 108 into threaded holes 130 in each mount as shown in FIG. 4. In an embodiment, the holes in platform 108 may be drilled so that the head of screws 140 may be sunk below the upper surface of platform 108

Figure 6:
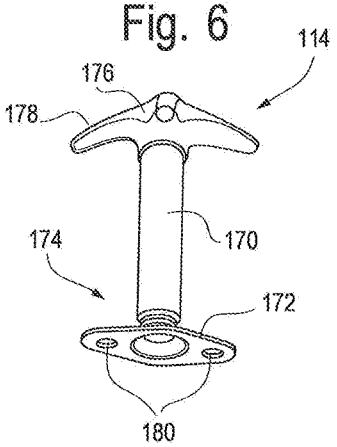
FIG. 6 depicts a clamp for use with the platform of FIG. 5.

Recessed areas 162 and 164 are provided for attaching clamps 114 and 116 of FIG. 2. Recessed areas 162 and 164 do not extend all the way through platform 108. A base 166 in the bottom of each opening includes holes 168 which receive screws (not shown) for attaching clamps 114 and 116. A close up of clamp 114 is shown in FIG. 6. Post 170 is attached to base 172 by means of a pivot 174. At the opposite end of base 172, post 170 is attached to a head 176 which one or more hooks 178 for use in securing a bucket or platform as described above. Openings 162 and 164 in platform 108 are shaped so as to accommodate base 172, which is attached by means of screws 120 through holes 180 in base 172 and holes 168 in platform 108.

Figure 6A:
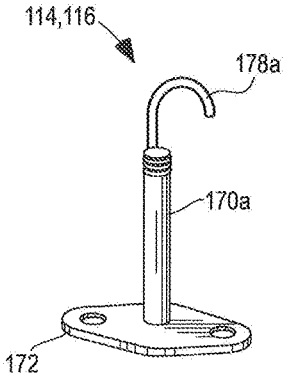
FIG. 6A depicts another clamp for use within the platform of FIG. 5.
Figure 7:
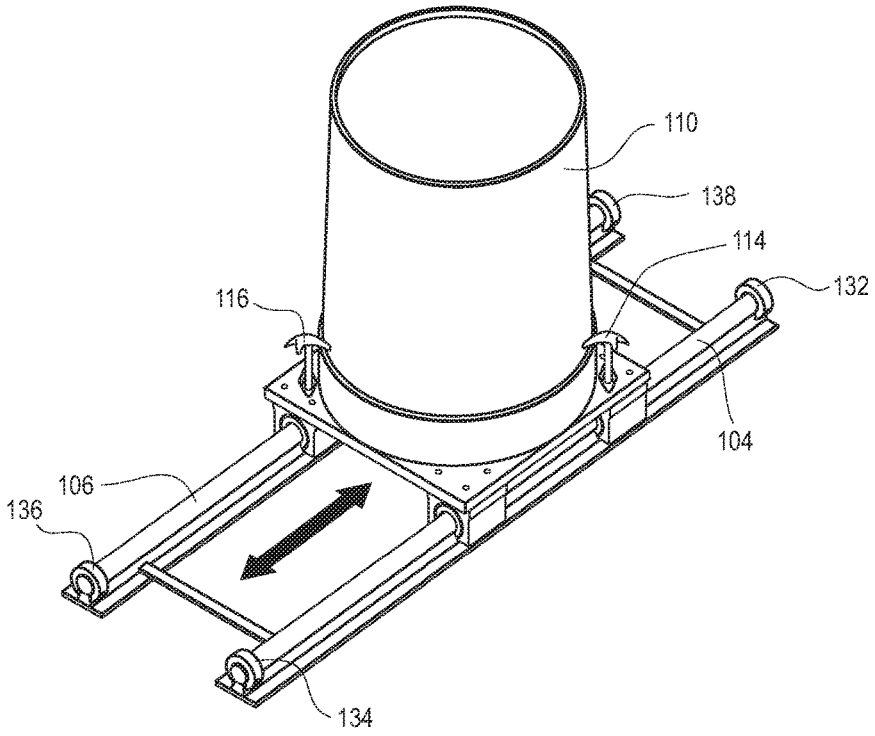
FIG. 7 depicts a baseball training device with an attached bucket.

Pivot 174 of clamp 114 allows clamps 114 (and 116) to be swiveled out of the way as a bucket is inserted in groove 112, then moved back and tightened over a ridge on the bucket 110. Pivot 174 features a spring or tensioning element so that post 170 may be pulled up and over the ridge on the bucket 110. In a further embodiment, clamps 114 and 116 may be, for example, rubber such as a bungee cord, or tie down strap. For example, referring to FIG. 6A, in one embodiment, the clamp 114 and/or 116 comprises a strap **170*a* (e.g., a bungee cord, a tie down strap) coupled to the base 172. Such strap 170*a* includes a hook 178*a* that engages with the ridge on the bucket 110 to secure the bucket 110 in the groove 112. FIG. 7 shows baseball training device 100 with a bucket 110 attached. In operation, a catcher is seated on bucket 110 and slides back and for the on the rails of device 100**. This allows the catcher to position his or her body behind a glove and provide a good target for the pitcher.

Numerous alternatives exist. For example, the bucket or seating platform may be provided with a cushion to provide more comfort while sitting. The baseball training device may be provided with straps or a handle to use when carrying the device. Platform 108 may be provided with a swivel mount for bucket 110 to provide a more natural motion for the person sitting on the bucket. In addition, parts of the baseball training device may be made with materials such as plastic, rubber or cloth.

If used and unless otherwise stated, the terms "upper," "lower," "front," "back," "over," "under," and similar such terms are not to be construed as limiting embodiments to a particular orientation. Instead, these terms are used only on a relative basis.

What is claimed is:

1. A baseball training device for use with a bucket having a bottom surface and an open top, said top having a circumference of a given diameter, the device comprising:

a frame comprising two parallel rails spaced a predetermined distance apart along their length; and a platform attached to said parallel rails, said platform having a top surface and a width that spans said predetermined distance between said parallel rails, wherein said platform is movable along said length of said rails, said platform further comprising a groove having a circumference approximately the same as the circumference of the top of the bucket for receiving the top of the bucket.

2. The baseball training device of claim 1, wherein the platform further comprises:

a plurality of mounts attached to said platform on a bottom surface opposite the top surface, each mount slideably engaging with one of the two parallel rails.

3. The baseball training device of claim 2, wherein each mount further comprises a plurality of ball bearings retained within a race.

4. The baseball training device of claim 2, wherein the platform is a square of approximately 1 foot on each side.

5. The baseball training device of claim 2, wherein said platform further comprises a plurality of clamps for engaging a lip around the circumference of the bucket for retaining the bucket in the groove.

6. The baseball training device of claim 2, wherein said platform further comprises a plurality of straps for retaining the bucket in the groove.

7. The baseball training device of claim 2, wherein the circumference of the groove is approximately the same as the circumference of the top of the bucket so that the bucket is retained in the groove by a friction fit.

8. The baseball training device of claim 1, wherein the frame is approximately 30 to 36 inches long.

9. The baseball training device of claim 8, wherein the frame further comprises:

two support members each attached to one of the parallel rails; and a plurality of braces attached between the support members to maintain the rails in a parallel orientation along their length.

10. The baseball training device of claim 8, wherein the frame further comprises:

stoppers attached at both ends of each rail to retain the platform on the rails.

* * * * *